US007588215B2

(12) United States Patent
Bogl

(10) Patent No.: US 7,588,215 B2
(45) Date of Patent: Sep. 15, 2009

(54) BENDING MOUNT FOR A MAGNETIC LEVITATION RAILWAY

(75) Inventor: Stefan Bogl, Neumarkt (DE)

(73) Assignee: Max Bögl Bauunternehmung GmbH & Co. KG, Sengenthal (DE)

( * ) Notice: Subject to any disclaimer, the term of this patent is extended or adjusted under 35 U.S.C. 154(b) by 0 days.

(21) Appl. No.: 12/095,387

(22) PCT Filed: Oct. 9, 2006

(86) PCT No.: PCT/EP2006/067201

§ 371 (c)(1),
(2), (4) Date: May 29, 2008

(87) PCT Pub. No.: WO2007/062893

PCT Pub. Date: Jun. 7, 2007

(65) Prior Publication Data

US 2008/0315045 A1 Dec. 25, 2008

(30) Foreign Application Priority Data

Nov. 30, 2005 (DE) ..... 10 2005 057 554

(51) Int. Cl.
*E01B 26/00* (2006.01)

(52) U.S. Cl. ..... 246/434; 104/130.11

(58) Field of Classification Search ..... 246/415 R, 246/430, 435 R, 442; 104/130.02, 130.03, 104/118, 119, 120, 121, 130.01, 281, 282, 104/124; 264/228; 52/223.8, 649.2, 834
See application file for complete search history.

(56) References Cited

U.S. PATENT DOCUMENTS 3,472,176 A * 10/1969 Lamartine ..... 104/130.11

* cited by examiner

*Primary Examiner*—Mark T Le
(74) *Attorney, Agent, or Firm*—Dority & Manning, P.A.

(57) ABSTRACT

A mount for a magnetic levitation railway has functional elements (9, 10, 11) for guidance of a vehicle for the magnetic levitation railway, on both sides along its longitudinal extent. The mount is in the form of a bending mount (2) of a switch arrangement and can be moved elastically from a first position of a first driving direction of the vehicle to at least one second position of a further driving direction of the vehicle. The bending mount (2) is produced essentially from concrete.

17 Claims, 3 Drawing Sheets

BENDING MOUNT FOR A MAGNETIC LEVITATION RAILWAY

FIELD OF THE INVENTION

The present invention relates to a beam for a magnetic levitation railway with functional elements on both sides of its longitudinal extension to guide a magnetic railway vehicle along its guideway. The beam has been executed as a bending beam of a switching arrangement that can be moved elastically from a first position of an initial driving direction of the vehicle to at least a second position of a further driving direction of the vehicle.

BACKGROUND

From DE 44 16 820 A1 it is known that the guideway of a magnetic high-speed railway consists of individual beams made of steel or concrete. So a magnetic high-speed railway vehicle can switch from one track to the other, steel bending switches are used that consist of a 75- to 150-m-long steel beam, for example, that can be elastically bent with the help of an electromechanical actuator. The desired bending line is generated by exerting the corresponding force on the steel beam. However, the disadvantage of this bending switch is that it has a beam made of steel so it can switch tracks. Furthermore, the steel beam is very simply made so it can be bent in the desired way. The utilization of steel as material for the bending beam has an adverse effect on the beam's vibration behavior. Due to the steel's low mass and the forces acting upon the beam—especially in a curved section of the track—relatively high vibrations on the beam can be expected, which lead to a bumpy ride of the vehicle on the magnetic levitation railway.

DE 20208421 U1 and DE 10 2004 015 495 A1 also describe steel bending beams for the track-switching device. The cross-sections of the beams shown therein have a small width so they can be slightly bent accordingly along their x-axis. The torsion-proof capability and the vibration sensitivity of such a beam must be assessed as disadvantageous. This is especially shown as well by the use of a vibration absorber arranged on the bending beam of DE 10 2004 015 495 A1.

Thus, the task of the present invention is to produce a beam suitable for a bending switch that will also avoid the disadvantages of a bending beam made of steel.

SUMMARY

The beam according to an embodiment of the invention that is made for a magnetic levitation railway includes functional elements for the guidance of a magnetic levitation railway vehicle. These functional elements extend along the x-axis of the beam—in other words, along the vehicle's driving direction. The functional elements consist of lateral guiding surfaces and sliding strips, as well as of stator packages that are part of the vehicle's drive. The arrangement of these functional elements and their separation from one another are determined by the way in which the vehicle is built. At any rate, a relatively low tolerance of these measurements is essential for allowing a safe and smooth operation of the magnetic levitation railway.

The execution of the beam as a bending beam of a switching device makes it possible to move the beam from a first position of an initial driving direction to at least a second position of a further driving direction of a vehicle. In the case of several directional switches (a 3-direction switch, for example), several positions are easily possible as well. While doing so, it is typically provided for the beam to be tightly clamped down on one end, and at the other end to be brought to the fixedly placed beams of the first or second driving direction for connection purposes. The fixedly placed beams of the first and second driving directions are made of concrete and connect with the bending switch beam at the same level, especially in the area of the functional elements so that the vehicle moves almost imperceptibly over the irregularities between the fixedly placed beam and the bending switch beam. The bending of the beam can be done with one single or several equally-oriented curvature radii or with two opposite-oriented curvature radii (i.e., S-shaped) as well so the vehicle can be diverted from a first driving direction to a second driving direction or to a second track running parallel to the first. Likewise, many switches can be combined with one another in order to change from one driving direction to another one. In this case, two or more switching arrangements can be oriented against each other in order to allow—depending on position of the bending switches—a straight course or a change to another track. The bending beams can also be moved to other positions, thereby creating a switch for several directions.

A special characteristic of this invention is that the bending beam is made mostly of concrete. This characteristic has great advantages that so far cannot be found in technical publications. Whereas according to the latest technical advances the corresponding bending switches are made mostly of steel to obtain an elastic component, it is now suggested by the present invention to make the bending beam of concrete to obtain a bending beam whose design corresponds to the other track beams and therefore can also accomplish a comparable driving handling in the vehicle. Both the accuracy of the beam's bending radius, as well as its vibration behavior and long useful life, thus improve a great deal as compared to a steel beam. It is especially the use of concrete for a beam with widely spaced functional elements that makes it difficult to bend the beam, but nonetheless this leads to particularly good results with respect to the driving handling of the magnetic levitation railway vehicle.

Typically, bending beams for use in a switching arrangement are 70 to 150 meters long. This length is needed for having sufficient free space between both fixedly placed bifurcating tracks in a permissibly large radius of the bifurcation, and in addition for the magnetic levitation railway vehicle to be able to pass through the non-driven track laid fixedly in place. To manufacture such long bending beams from concrete, it is therefore advantageous for the bending beam to consist of several pre-assembled concrete units arranged next to one another and tensed together with pre-stressed elements to form one long, single bending beam so it can exert an effect and be uniformly bent to the intended curvature. The individual beams made of pre-assembled concrete units could have a length of about 15 m, for example.

It would be advantageous for the pre-stressed elements to be under such stress that the beam would then undergo no tensile stress, even when bent. This would ensure the continuous rigidity of the concrete, even if the beam has been bent to its maximum deflection. For the concrete to remain rigid, it is essential for it to be under constant pressure. For this reason, the pre-stressed elements have been pre-stressed so much that this is also ensured in the external part of the beam's bend in every one of its positions.

If the cross-section of the bending beam is a hollow box girder, the beam's high rigidity is maintained but nonetheless it is possible to bend the concrete beam. As a result of this, the bending forces can be reduced compared to a full cross-section. Additionally, the hollow box girder cross-section makes it possible for the bending beam to have a high resistance to torsion, thus preventing its twisting.

It is especially advantageous for the concrete to have a low elasticity module (such as E=28,000). This can be accomplished, for example, with a light normal concrete or by adding Liapor to the light concrete. As a result of this, the bending beam can be bent relatively easy and be sufficiently elastic so it can be brought back to its initial position. By using concrete in the bending beam, the beam maintains an especially high degree of its own mass, and this contributes favorably to dampen vibration in the bending beam. Typically, special measures for dampening vibration in the beam are therefore not needed, Especially advantageous has been a bending beam with a height and width ratio between 1 and 1.5, preferably of about 1.25, so the bending beam can achieve a particularly good vibration dampening and resistance to torsion yet can still be bent from the first to the second position of the vehicle's further driving direction. Thanks to the relatively wide execution of the beam relative to its height, a very stable and yet more elastic beam is obtained. A twisting of the beam by bending it and/or by the vehicle driving over the bending switch is thus reliably prevented. In addition, this makes it possible to select a relatively large support separation for the bending beam. Separations of 15 m are therefore feasible.

Even with respect to the total width of the beam including the functional elements, the width of the beam without the functional elements can be large. Especially advantageous has been a ratio between 2 and 3, preferably between 2 and 2.5. This ratio allows the beam to be bent as needed without interfering with the vehicle's driving, especially with respect to the stator elements and the lateral guiding rails. A continuous and constant bending line can be accomplished with such a ratio.

To facilitate the bending of the beam, it is advantageous if the functional elements are connected to the bending beam with cantilever arms. The cantilever arms, which can be part of the beam's upper flange, determine the space of the lateral guiding rails and the stator elements from one another. The cantilever arms, as the upper flange of the bending beam, also contribute to its rigidity. The hollow box girder of the bending beam itself can be made narrower than required by the separation of the lateral guiding rails and the stator elements, thereby allowing the bending beam to be more easily bent.

If the cantilever arms are made of concrete and especially manufactured as one piece with the bending beam, then the beam with the cantilever arms can be manufactured relatively cheaply. In this case, the cantilever arms can be made simultaneously as one piece with the bending beam, but can also be tensed against it with tensioning media. Depending on specific conditions, both can lead to an advantageous manufacturing and/or assembly.

If the cantilever arms have slits perpendicular to the bending line, then this arrangement can very advantageously cause the bending line of the bending beam to be taken more easily. The tensile and compressive strains, created precisely on the cantilever arms located far away from the middle bending line when the beam is bent, are hereby minimized. The bending of the concrete bending beam is thus possible without the risk of damaging the concrete near the cantilever arms.

The slits are advantageously separated from one another by about 0.5 to 2 m, especially by about 1 m, and as a result of this, the bending of the concrete bending beam is relatively easy.

Optionally to the arrangement of the cantilever arms as an integrated element of the beam, the invention can provide the cantilever arms to be designed as separated consoles. In this case, the consoles can be made of concrete or steel. It would be advantageous for the cantilever arms to be tensed to the concrete beam so they can be permanently fastened on the beam in the exact position.

Displacing media are provided for bending the bending beam; they would at least exert their effect on the free end of the bending beam for bending or pushing it to its desired position. These suitable displacement media could be hydraulic or electric drives that exert their effect on the free end or additionally on the areas of the bending beam lying in between.

To displace the beam with little friction, the bending beam should preferably be embedded on running wheels, which could be fastened to it, for example, and move the bending beam to a displacement direction provided for it.

To obtain a largely uniform or pre-determined curvature of the bending beam, the invention advantageously provides the displacement direction for the bending beam to be limited by stops placed along it. As a result of this, the bending beam is correspondingly bent to the provided stop. Since the stops have been arranged increasingly farther from the neutral line in the guideway of the bending beam, when the beam is deflected it clings to these stops and brings about the predetermined, largely uniform curving of the bending beam.

Additional advantages of the invention are described in the practical examples listed below, which show:

DETAILED DESCRIPTION

Figure 1:
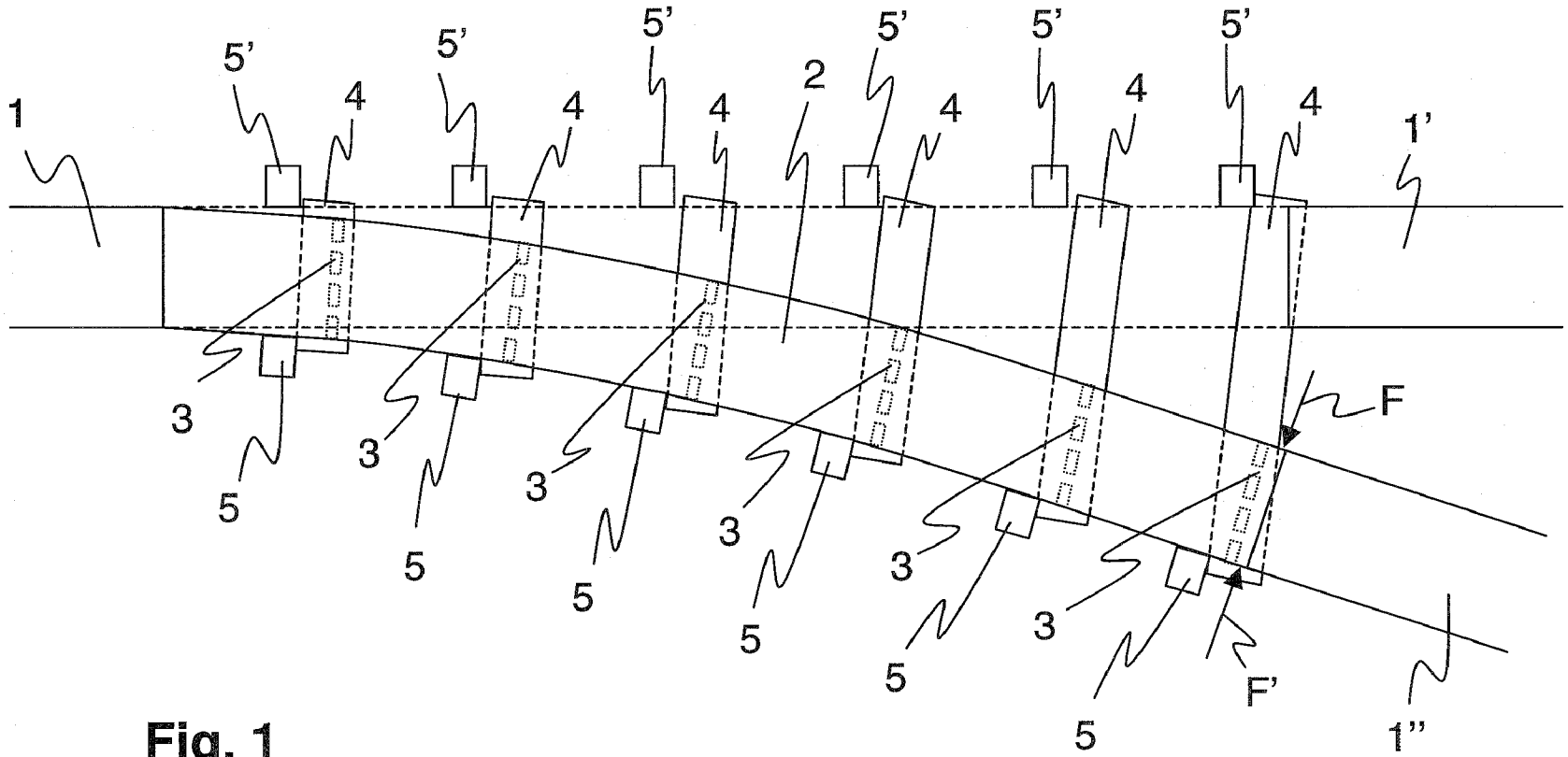
FIG. 1 A diagrammatic representation of a top view of a switching arrangement.

Reference will now be made to embodiments of the invention, one or more examples of which are illustrated in the drawings. Each embodiment is presented by way of explanation of the invention, and not as a limitation of the invention.

FIG. 1 shows a diagrammatic representation of a top view of a magnetic levitation railway switching arrangement. The magnetic levitation railway consists of fixedly placed beams 1, 1' and 1". Beams 1 and 1' represent a first driving direction for a magnetic levitation railway vehicle, while beams 1 and 1" are the vehicle's second driving direction. So the first or second driving direction can be selected for driving, a bending beam 2 has been placed between beams 1 and 1' or 1 and 1". The bending beam 2 is fixed in position near beam 1, but moveable near beam 1' or 1". Movement is accomplished by introducing a force F or F', which—when distributed—acts on the bending beam 2, either on the end of the bending beam 2 or divided over the length of the bending beam 2. Force F or F' causes the free end of the bending beam 2 to run either aligned with beam 1' or beam 1". The aligned course refers especially to guiding elements for guiding a magnetic levitation railway vehicle, explained in detail in FIG. 2. The shape of beams 1, 1' and 1", on the other hand, can deviate from the shape of the bending beam 2.

The bending beam 2 is configured with running wheels 3. The running wheels 3 support the bending beam 2 with respect to a track 4 on which the running wheels 3 roll when the bending beam 2 is bent between the first and second driving directions.

To limit the displacement direction of the bending beam 2 in such a way that a pre-determined course of the bending beam 2 is maintained, stops 5 or 5' are provided along the bending beam 2. If a force F acts on the bending beam 2, the final position of the bending beam 2 is pressed against the stops 5 arranged along the bending beam 2. Thus, the track constitutes a course from the beam 1 continuing through the bending beam 2 to the beam 1' with a continuous curvature or a pre-determined one according to the stops 5. On the other hand, if the bending beam 2 is pressed by the force F along a course that connects the beams 1 and 1', then the bending beam 2 is pressed against the stops 5', thereby forming a straight course of the first driving direction. Needless to say, the stops 5 and 5' can be arranged differently, so that for example there could be a curvature both in one stop against the stops 5 and in the stops 5' of the bending beam 2.

The clearance between both beams 1 and 1' must be so large that a vehicle will not make contact with the corresponding shut-down beam 1 or 1' during a first and second driving direction.

Figure 2:
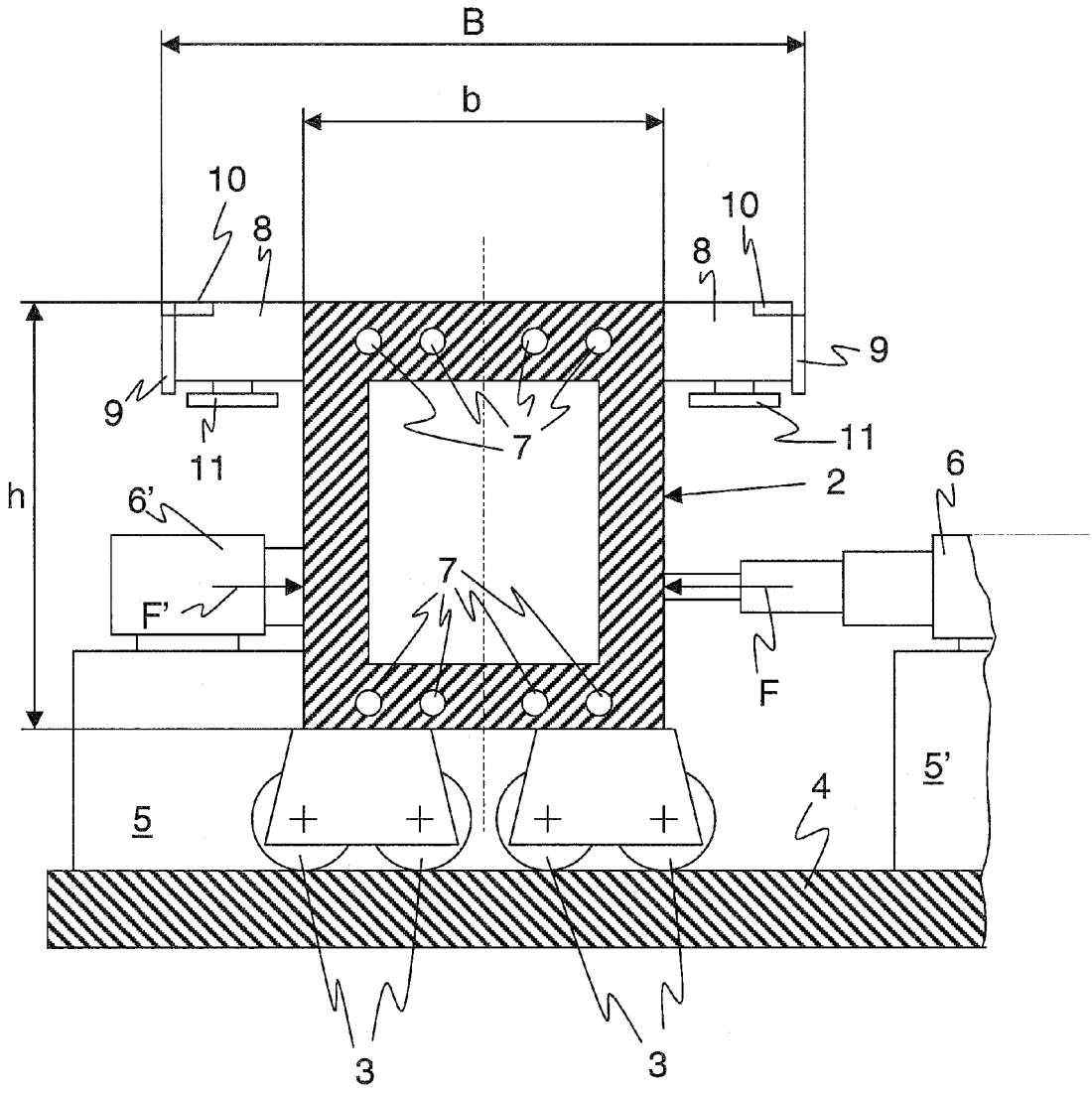
FIG. 2 A diagrammatic cross-section of a bending beam.

FIG. 2 shows a cross-section of a bending beam 2. The bending beam 2 has been configured on running wheels 3 that roll on the track 4. A drive 6—here shown diagrammatically as a hydraulic cylinder—presses with a force F against a lateral wall of the bending beam 2, thereby displacing the bending beam 2 on the track 4 until it makes contact with the stop 5. If the other driving direction should be driven over, then another drive 6' placed opposite drive 6 presses with a force F' against a lateral wall of the bending beam 2 and displaces the bending beam 2 on its rolling wheels 3 and the track 4 until it is pressed against the stop 5'. Naturally, instead of the hydraulic cylinders 6 and 6' other drives, such as electric drives with a set of gears or a cogwheel mechanism, are also possible. Even drives of the rolling wheels 3 that comb the cogwheels and displace the bending beam while doing so are possible as well.

The bending beam 2 is now described in more detail. The bending beam 2 is made largely of concrete, specifically of pre-assembled concrete. Owing to the typically significant length (up to 150 meters) of the bending beam 2, it is better for the bending beam 2 to be made of several pre-assembled concrete units tensed together. The concrete pre-assembled units are tensed by pre-stressing the units arranged as jacket tubes 7 in the upper and lower flanges of the bending beam 2.

The bending beam 2 is largely made of hollow box girders to achieve an especially high torsional rigidity. In order to have very high rigidity in the transversal direction of the bending beam 2 to obtain a dimensionally stable beam, the width b and the height h of the bending beam 2 have been selected to be roughly equal. If need be, the width b of the bending beam 2 can be slightly smaller than the height h of the bending beam 2 to facilitate the exertion of the bending forces to displace the switch with the drives. In an isolated instance, the ratio of width b to height h of the bending beam 2 depends, among other things, from the length of the bending beam 2 and from the adjustment distance of the bending beam 2. However, it is more advantageous if the bending beam 2 is made wider, if possible, so it can remain stable when a magnetic levitation railway vehicle drives over it.

The pre-stressed elements 7 in the hollow box girders cause such a large pre-tensioning (even under maximum bending conditions) that the bending beam 2 has no tensile stresses that would weaken the concrete. This means that the compressive stress acting on the concrete must be so large—especially on the outer curvature region of the bending beam 2—that the tensile stress in this area is superimposed by the higher compressive stress in this region. As a result of this, the concrete of the bending beam 2 is constantly under compressive stress, thus obtaining its rigidity.

Cantilever arms 8 have been arranged on the upper flange of the ending beam 2, and the functional elements for guiding the magnetic levitation railway vehicle have been placed on their external side. The functional elements consist of two oppositely arranged lateral guide rails 9 that must be placed in precise separation from one other for vehicle-guiding purposes. Sliding strips 10 have been provided for the upper side of the cantilever arm 8, so the vehicle can settle down when it is not moving. Long stators that are part of the vehicle's drive have been placed on the lower side of the cantilever arms 8. To facilitate the bending of the bending beams 2, the cantilever arms 8 located along the bending beams 2 are not continuously arranged, but placed at a certain distance from each other when seen in the longitudinal direction of the bending beam 2. In this case, respective slits are separated by a separation distance a from 0.5 to 2 m (especially about 1 m) in the longitudinal direction of the bending beam 2. As a result of this, the bending beam 2 can be bent a lot easier than it would be with continuous cantilever arms 8. The slits 12 (FIG. 3) between the cantilever arms 8 more or less become smaller or greater when the bending beam 2 is bent. In this case, the functional elements 9, 10 and 11 can also be either elongated or compressed or are subdivided according to the length of the cantilever arms 8 and form a gap with one another according to the bending line of the bending beam 2.

Figure 3:
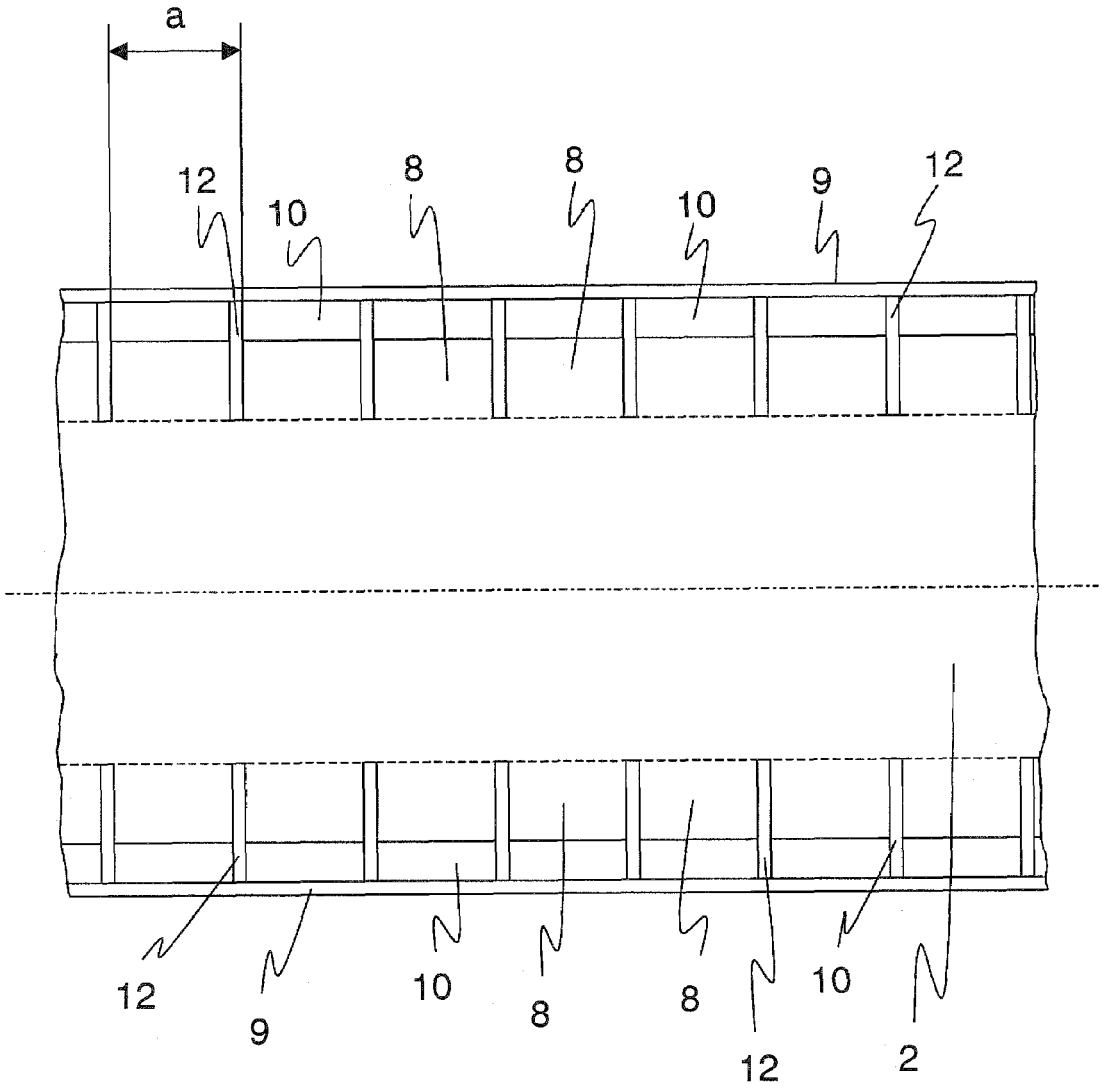
FIG. 3 A top view of a bending beam.

FIG. 3 shows a top view of a bending beam 2. Many cantilever arms 8 separated from one another are seen on both sides along the bending beam 2. Every cantilever arm 8 has a sliding strip 10 and is also set at a distance from the other and separated from one another by slits 12. In the practical example shown here, the lateral guide rails 9 are continuous. This means that the lateral guide rail 9 spans over the slit 12. A corresponding elongation or compression of the lateral guide rails 9 has no adverse affect on the rails 9 or the vehicle's guidance as long as the bending beam 2 is bent in a typical way. However, the lateral guide rails 9 can also be interrupted. A vehicle of the magnetic levitation railway can bridge the minor gaps among the individual lateral guard rails 9 in the longitudinal direction of the bending beam 2.

The cantilever arms 8 can be either an integral part of the bending beam 2—in other words, be cast from concrete together with the bending beam 2—or individual parts of the cantilever arms 8 can be made of concrete or steel and stressed along the bending beam 2. The stressing of the cantilever arms 8 on the bending beam 2 can be accomplished by pre-stressed bars running through transversally with respect to the longitudinal direction and also be used for fastening the lateral guide rails 9.

It is advantageous for a total width B of the bending beam 2, including the cantilever arms 8 and lateral guard rails 9, to be between 2 and 3, preferably between 2 and 2.5 ($2>B/b>3$) in relation to the width b of the bending beam 2 without cantilever arms 8. As a result of this, a stable bending beam 2 is created that can nevertheless be brought into the desired curvature. In order to obtain an elastic bending of the concrete bending beam 2, it is especially advantageous for the concrete to have a small elasticity module such as E=28,000 for example. This results in the creation of a concrete bending beam 2 that can be easily bent and also withstand the numerous bendings of the occurring loads without causing the concrete to crack, something that would not be permissible. It is especially the utilization of such concrete that makes the manufacturing of the bending beam 2 possible or that requires the bending beam 2 to be designed as a hollow box girder of relatively large dimensions. Therefore, the bending beam 2 is able to support a vehicle of the magnetic levitation railway to move over it, in spite of utilizing such concrete.

This invention is not limited to the practical examples described herein. Modifications that fall under the framework of the patent claims are possible at any time. Especially the way in which the bending beams are formed, the shape of the bending beam 2, as well as the introduction of force and the means of propulsion can differ from the ones used in the practical example. At any rate, it is essential for the bending beam 2 to be bent in an intended way and yet remain sufficiently stable to allow the vehicle of a magnetic levitation railway to move over it with torsional rigidity but without vibration. In addition, this switch is much more durable (i.e., has a longer useful life) than one made of steel.

The invention claimed is:

1. A bending beam for a switching arrangement of a magnetic levitation railway, said beam comprising:

functional elements configured along longitudinal sides of said beam for guidance of a magnetic levitation vehicle along said beam;

said beam having a hollow box girder cross section along substantially its entire longitudinal length;

said beam formed substantially entirely of concrete; and wherein in a switching arrangement, said beam has a fixed longitudinal end and is elastically deformable such that an opposite longitudinal end is movable between a first position to a second position to change a driving direction of the vehicle.

2. The beam as in claim 1, wherein said beam comprises a plurality of pre-assembled concrete units joined together to form said beam with pre-stressed elements.

3. The beam as in claim 2, wherein said pre-stressed elements have a degree of tension such that said beam undergoes essentially no tensile stress when bent between the first and second positions.

4. The beam as in claim 2, wherein said pre-stressed elements are disposed through tubes in upper and lower flanges of said girder cross section beam.

5. The beam as in claim 1, wherein said concrete has an elasticity module of about E=28,000.

6. The beam as in claim 1, wherein a ratio of a height (h) to width (b) of said beam is between 1 and 1.5.

7. The beam as in claim 1, wherein a ratio of a width (B) of said beam and said functional elements to a width (b) of said beam without said functional elements is between 2 and 3.

8. The beam as in claim 1, wherein said functional elements are connected to said beam by cantilever arms that extend outward from longitudinal sides of said beam.

9. The beam as in claim 8, wherein said cantilever arms are made of concrete and formed integrally with said beam.

10. The beam as in claim 8, wherein said cantilever arms have an upper surface that is flush with an upper flange of said beam.

11. The beam as in claim 10, wherein said cantilever arms are formed separately from beam and attached along said beam in a spaced apart configuration.

12. The beam as in claim 10, wherein said cantilever arms are made of concrete and formed integrally with said beam.

13. The beam as in claim 8, wherein said cantilever arms comprise slits oriented perpendicular to a bending axis line of said beam.

14. The beam as in claim 13, wherein said slits are spaced apart a distance (a) of about 0.5 to 2.0 m.

15. The beam as in claim 1, further comprising means for driving said beam between said first and second positions.

16. The beam as in claim 1, further comprising wheels configured on a bottom flange of said beam for rolling movement of said beam between said first and second positions.

17. The beam as in claim 1, further comprising stops provided along a longitudinal length of said beam that engage said beam at said first and second positions.

* * * * *